US006363686B1

(12) United States Patent
Heide

(10) Patent No.: US 6,363,686 B1
(45) Date of Patent: Apr. 2, 2002

(54) APPARATUS FOR LINEAR TRANSPORT OF BLOCK-SHAPED CIGARETTE PACKETS PREPARATORY TO TESTING THE QUALITY OF THEIR ADHESIVE BONDS

(75) Inventor: Jirko Heide, Schwarzenbek (DE)

(73) Assignee: Topack Verpackungstechnik GmbH, Schwarzenbek (DE)

( * ) Notice: Subject to any disclaimer, the term of this patent is extended or adjusted under 35 U.S.C. 154(b) by 0 days.

(21) Appl. No.: 09/551,396

(22) Filed: Apr. 17, 2000

(30) Foreign Application Priority Data

Apr. 17, 1999 (DE) ..... 199 17 457

(51) Int. Cl.[7] ..... B65B 57/00

(52) U.S. Cl. ..... 53/53; 53/54; 53/494; 53/498; 53/500

(58) Field of Search ..... 53/53, 54, 494, 53/498, 500, 64, 69; 493/16, 20; 198/626.1, 626.5, 604

(56) References Cited

U.S. PATENT DOCUMENTS 4,238,025 A 12/1980 Manservisi
4,349,998 A * 9/1982 Covert ..... 53/53
4,645,921 A 2/1987 Heitmann et al.
4,721,119 A 1/1988 Ludszeweit et al.
4,912,554 A 3/1990 Neri
4,969,551 A 11/1990 Heitmann et al.
5,240,117 A 8/1993 Focke et al.
5,412,926 A * 5/1995 Focke ..... 53/53

FOREIGN PATENT DOCUMENTS

DE 38 01 388 7/1988
DE 41 12 263 10/1992
DE 196 27 225 1/1998

* cited by examiner

*Primary Examiner*—Rinaldi I. Rada
*Assistant Examiner*—Sameh Tawfik
(74) *Attorney, Agent, or Firm*—Venable; Robert Kinberg

(57) ABSTRACT

Cigarette packets of a file wherein packets having satisfactory envelopes are randomly distributed among packets with defective envelopes, particularly envelopes having improperly glued and/or loose flaps, are advanced by a belt conveyor between two laterally adjustable guides. The guides bear upon the adjacent fold lines for pairs of mirror symmetrical flaps with a force which suffices to intensify the defects of envelopes with one or more non-adhering or improperly adhering flaps. This facilitates subsequent detection and segregation of packets having defective envelopes.

17 Claims, 2 Drawing Sheets

APPARATUS FOR LINEAR TRANSPORT OF BLOCK-SHAPED CIGARETTE PACKETS PREPARATORY TO TESTING THE QUALITY OF THEIR ADHESIVE BONDS

CROSS-REFERENCE TO RELATED CASES

This application claims the priority of commonly owned German patent application Ser. No. 199 17 457.1 filed Apr. 17, 1999. The disclosure of the above-referenced German patent application, as well as that of each U.S. and foreign patent and patent application mentioned in the specification of the present application, is incorporated herein by reference.

BACKGROUND OF THE INVENTION

The invention relates to improvements in methods of and in apparatus for testing block-shaped commodities. Typical examples of such commodities are packets containing arrays of parallel plain or filter cigarettes or other rod-shaped smokers' products. For the sake of simplicity, this specification will refer primarily to commodities which constitute cigarette packets; however, it is to be understood that the invention can be practiced with equal or similar advantage in connection with the testing of other (analogous) block-shaped commodities.

A finished cigarette packet (be it a so-called soft pack or a so-called hinged lid pack) normally contains at least one inner envelope or wrapper of paper, lightweight cardboard or flexible plastic sheet material, and an outer envelope or wrapper which normally consists of cellophane or an analogous transparent or translucent plastic sheet or film material. It is also customary to provide the inner envelope with a liner of metallic foil. The blanks which are converted into inner and outer envelopes are provided with flaps which are connected to the adjacent portions of the respective envelopes along elongated fold lines, and the flaps are glued, welded and/or otherwise bonded to the adjacent portions of finished envelopes. As a rule, at least the outer envelope of a cigarette packet is provided with two elongated parallel lateral flaps flanking the bottom panel and the top panel of the respective envelope.

It is advisable and customary to test successive packets which issue from a cigarette packing machine in order to ascertain the quality and/or the presence or absence of bonds between the flaps (especially the afore-discussed lateral flaps) and the adjacent portions of the respective envelopes. The monitoring can take place between a packing machine and a next-following cellophaning machine and/or between the cellophaning machine and a next-following carton filling machine. The assignee of the present application distributes production lines wherein a cigarette packing machine known as COMPASS 500 is followed by a machine known as C 90 and serving to confine successive packets issuing from the COMPASS 500 into transparent film. The C 90 machine is followed by a so-called B 90 pack boxer which confines arrays of, for example, ten cellophaned cigarette packets each in discrete cartons, e.g., in cartons wherein two elongated layers of five coplanar cellophaned packets each overlie one another.

Testing of cigarette packets for the potential presence of defective envelopes (such as envelopes having loose flaps or distorted (deformed) flaps) is advisable for a number of important reasons. For example, a defective envelope can cause the corresponding packet to obstruct the path between successive machines of a production line which starts, for example, with at least one cigarette maker (such as the maker known as PROTOS which is distributed by the assignee of the present application) and ends with at least one so-called CP 90 case packer (also distributed by the assignee of the present application) which turns out boxes or cases each of which can contain a staple of, e.g., fifty cartons of 200 cigarettes each. Another reason for the testing of envelopes is to avoid inconvenience to the purchasers, e.g., because a packet having an outer envelope with one or more loose flaps adheres to the adjacent packet or packets.

A testing apparatus is not likely to reliably detect each packet having an envelope with one or more loose flaps, for example, if a loose flap properly overlies but does not actually adhere to the adjacent portion of the envelope. Nevertheless, such packets should be segregated from packets having satisfactory envelopes or wrappers because a defective envelope is likely to create problems in a production line downstream of the testing apparatus.

OBJECTS OF THE INVENTION

It is an object of the present invention to establish for an envelope testing apparatus circumstances which are highly likely to enable presently known testing apparatus to locate and to initiate segregation (ejection) of all packets having envelopes with one or more loose and/or inadequately bonded flaps and/or analogous defects.

Another object of the present invention is to provide a simple and inexpensive method of influencing defective envelopes of cigarette packets in such a way that the defective envelopes are more likely to be detected by resorting to available testing or monitoring apparatus.

A further object of the instant invention is to provide an apparatus which can be readily installed in existing production lines for packets containing plain or filter cigarettes or other rod-shaped products of the tobacco processing industry.

An additional object of the invention is to provide the above outlined apparatus with novel and improved means for influencing the shapes of defective envelopes while the respective packets are on their way toward an envelope monitoring station.

Still another object of this invention is to provide a novel and improved method of facilitating detection and segregation of cigarette packets having defective envelopes from packets with satisfactory envelopes.

A further object of the invention is to provide an apparatus of the above outlined character which does not adversely affect the shape, the condition and/or other desirable characteristics of packets having satisfactory envelopes or wrappers.

SUMMARY OF THE INVENTION

One feature of the present invention resides in the provision of an apparatus for detection of defective envelopes which form part of at least substantially block-shaped commodities. The improved apparatus comprises means for advancing, in a predetermined direction and along a predetermined path, successive commodities of a series of commodities including randomly distributed commodities having satisfactory envelopes and commodities having defective envelopes, means for subjecting the envelopes of successive commodities of the series to the action of deforming forces during advancement of commodities along a first portion of the path with attendant intensification or enhancement of defects of defective envelopes, and means for monitoring successive commodities in a second portion of the path downstream of the first portion for the purpose of detecting the commodities having defective envelopes. In other words, the monitoring means is put to use subsequent to intensification or enhancement of defects of the defective envelopes.

The first portion of the path is or can be at least substantially straight.

The means for subjecting the envelopes to the action of deforming forces can include at least one guide which is adjacent one side of the first portion of the path. If the envelopes have external flaps which are connected to the adjacent portions of the respective envelopes by elongated fold lines, and if the purpose of the monitoring means is to detect flaps which do not adhere and/or do not adequately adhere to the adjacent portions of the respective envelopes, the commodities are advanced along the predetermined path in such a way that the fold lines are at least substantially parallel to the at least substantially straight first portion of the path during advancement of the respective envelopes along the first path portion; in accordance with a presently preferred feature of the invention, the at least one guide is then provided with a surface bearing upon a fold line of the envelope in the first portion of the path. The commodities can constitute packets which contain arrays of rod-shaped smokers' products. Such commodities have external facets which flank the respective elongated fold lines, and the surface of the at least one guide preferably makes an oblique angle (most preferably an acute angle) with at least one facet flanking the fold line which is being advanced along the first portion of the path. At least as a rule, the surface of the at least one guide is in mere linear contact with the envelopes of commodities which are being advanced along the first portion of the path.

The advancing means can comprise a conveyor including at least one endless flexible element (such as a belt, chain or band) having an upper reach which is arranged to advance the series of commodities at least along the first portion of the path.

The at least one guide preferably ends (i.e., it has a downstream end) upstream of the second portion of the path. Otherwise stated, the means for subjecting the envelopes of successive commodities of the series to the action of deforming forces is interrupted or terminates at the second portion of the path.

As a rule, or at least in many instances, the envelopes have pairs of external flaps and parallel elongated fold lines for such pairs of flaps. The advancing means is arranged to advance the commodities in such a way that the fold lines are at least substantially parallel to the first portion of the path, and the aforementioned subjecting means can include two guides which are adjacent opposite sides of the first portion of the path and each of which has a surface bearing upon one of the two fold lines of the envelope in the first portion of the path.

The apparatus preferably further comprises means for adjusting the subjecting means (such as the aforementioned guide or guides) at least substantially transversely of the first portion of the path. If the subjecting means comprises two members (such as the aforediscussed guides) which are disposed at opposite sides of the first portion of the path and are arranged to simultaneously engage an envelope in the first portion of the path, such members are preferably movable (adjustable) toward and away from each other at least substantially transversely of the first portion of the path. This enhances the versatility of the apparatus because the latter can test the qualities of envelopes forming part of narrower or wider commodities.

The apparatus can further comprise at least one guide for commodities which are being advanced along a third portion of the path downstream of the second portion.

Another feature of the invention resides in the provision of a method of enhancing the detection of defective envelopes forming part of at least substantially block-shaped commodities (such as soft or hinged lid packets containing arrays of rod-shaped smokers' products). The improved method comprises the steps of advancing—in a predetermined direction and along a predetermined path—successive commodities of a series of commodities including randomly distributed commodities having satisfactory envelopes and commodities having defective envelopes, subjecting the envelopes of successive commodities of the series to the action of deforming forces during advancement of commodities in a first portion of the path with attendant intensification (and hence more reliable detectability) of defects of defective envelopes, and monitoring successive commodities in a second portion of the path downstream of the first portion to detect the commodities having defective envelopes.

As a rule, the envelopes include flaps and the flaps of satisfactory envelopes are glued, welded and/or otherwise bonded to adjacent portions of the respective envelopes. The flaps of defective envelopes are or can be at least partially loose, and the subjecting step then includes moving loose flaps and/or unsatisfactorily bonded flaps relative to the adjacent portions of the defective envelopes. If the envelopes include pairs of at least substantially mirror symmetrical flaps, the subjecting step preferably includes simultaneously applying deforming forces to pairs of flaps during advancement of the respective envelopes in the first portion of the path.

The second portion of the path is or can be closely or even immediately adjacent the first portion of the path. This is often desirable on the ground that the deformation of defective envelopes still exists during monitoring of such envelopes in the second portion of the path.

The novel features which are considered as characteristic of the invention are set forth in particular in the appended claims. The improved apparatus itself, however, both as to its construction and its mode of operation, together with numerous additional important and advantageous features and attributes thereof, will be best understood upon perusal of the following detailed description of certain presently prefered specific embodiments with reference to the accompanying drawings.

DESCRIPTION OF PREFERRED EMBODIMENTS

Figure 1:
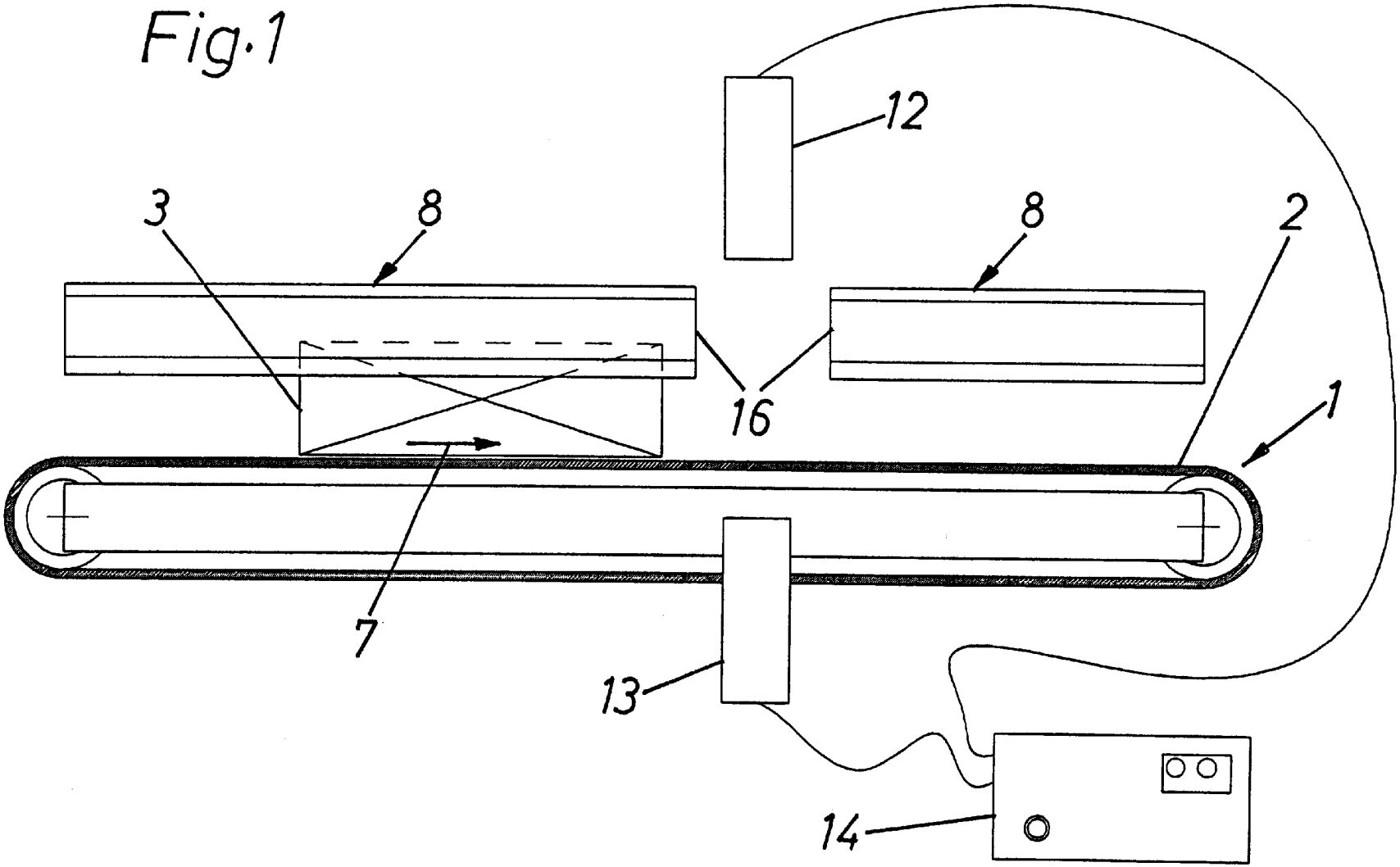
FIG. 1 is a diagrammatic side elevational view of an apparatus which embodies one form of the invention and is arranged to receive a series of successive packets from a cigarette packing machine.
Figure 2:
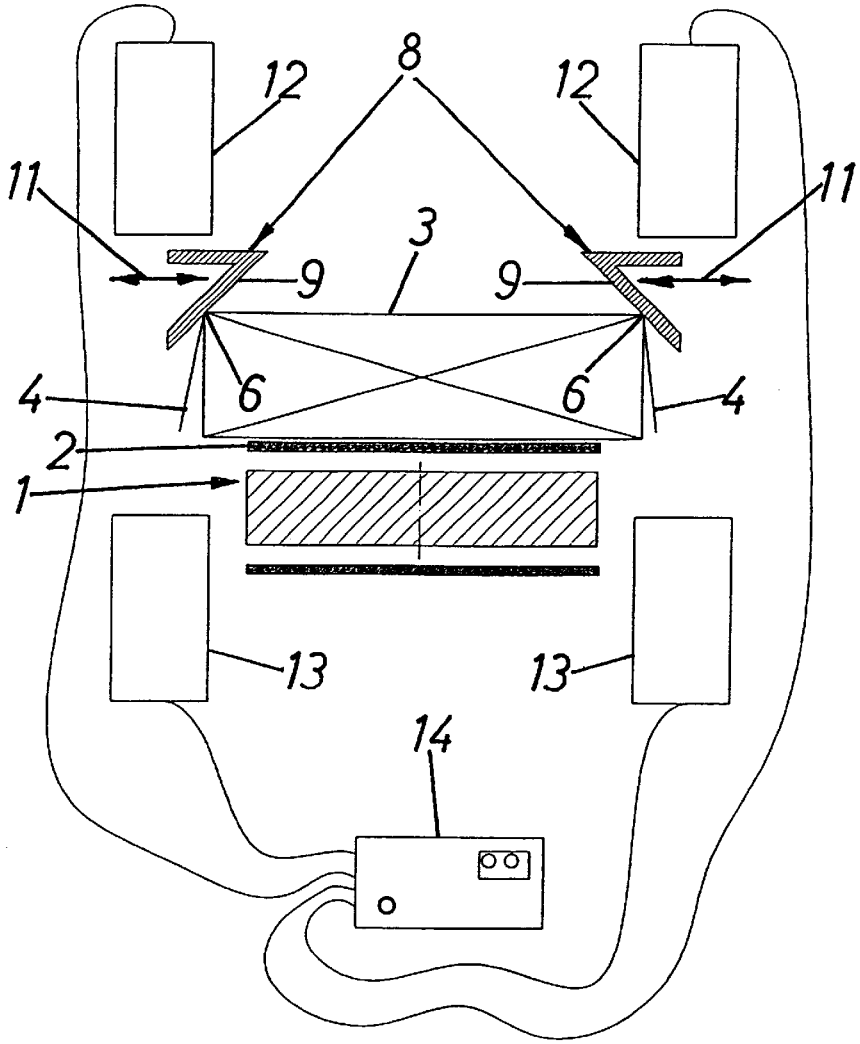
FIG. 2 is a schematic transverse vertical sectional view of the apparatus, the section being taken across the first portion of the path for successive cigarette packets.

FIG. 1 shows an elongated belt, band or chain conveyor 1 including an endless flexible element 2 with a horizontal upper stretch or reach which defines an elongated horizontal path arranged to confine a series of successive randomly distributed satisfactory and defective block-shaped commodities 3 to advancement in the direction indicated by an arrow 7. More specifically, the quality or condition of the commodities 3 (each of which is assumed to constitute an elongated cigarette packet) is determined by the condition of their envelopes or wrappers having flaps 4 two of which are shown in FIG. 2. The envelope including the two flaps 4 shown in FIG. 2 is a defective or unsatisfactory envelope because the flaps do not adhere to the adjacent portions of such envelope.

An important object of the present invention is to ensure that, when the packet 3 including the envelope having the flaps 4 of FIG. 2 reaches an optoelectronic (or any other suitable) testing or monitoring unit (an optoelectronic unit is shown in FIG. 2), the defects of such envelope are so readily detectable that the respective packet is reliably detected, i.e., the monitoring unit is compelled to generate one or more signals which induce (and preferably compel) a mechanical, pneumatic or other suitable ejecting unit (not shown) to segregate the illustrated packet from packets having satisfactory outer envelopes. For example, a packet 3 having an envelope which has been found to be defective can be expelled from the path for packets having satisfactory envelopes by resorting to a reciprocable plunger and/or one or more nozzles arranged to discharge one or more jets of compressed gaseous fluid.

The path which is defined by the upper reach of the endless flexible element 2 of the conveyor (packet advancing means) 1 includes a first portion accommodating two elongated parallel guide members (hereinafter called guides) 8 which are mirror images of each other with reference to a vertical plane extending at right angles to the plane of FIG. 2. These guides constitute means for subjecting the outer envelopes of successive packets 3 of a series of successive packets to the action of deforming forces during advancement of packets between the two guides 8.

The first portion of the path is followed by a second portion immediately downstream of the first portion and upstream of a third path portion extending between two relatively short additional guides 8 one of which can be seen in FIG. 1. Such additional guide(s) 8 compels or compel successive freshly monitored packets 3 to advance toward and into the aforementioned ejecting station (not shown) wherein the packets having defective envelopes are segregated from packets having acceptable envelopes or wrappers.

The upper reach of the endless flexible element 2 of the conveyor 1 can receive packets 3 from a magazine (not shown) or directly from a suitable packing machine (such as the aforementioned COMPAS 500). Such machine discharges a series or file wherein packets having acceptable outer envelopes are randomly distributed among packets having defective outer envelopes. The flaps 4 which are shown in FIG. 2 are connected to the adjacent portions of the envelope by two elongated parallel fold lines 6. When properly bonded to the adjacent portions of an outer envelope, the flaps constitute the two longitudinally extending elongated, narrow and parallel sidewalls of the satisfactory envelope, and such flaps extend all the way from the top panel to the bottom panel of the envelope.

Figure 3:
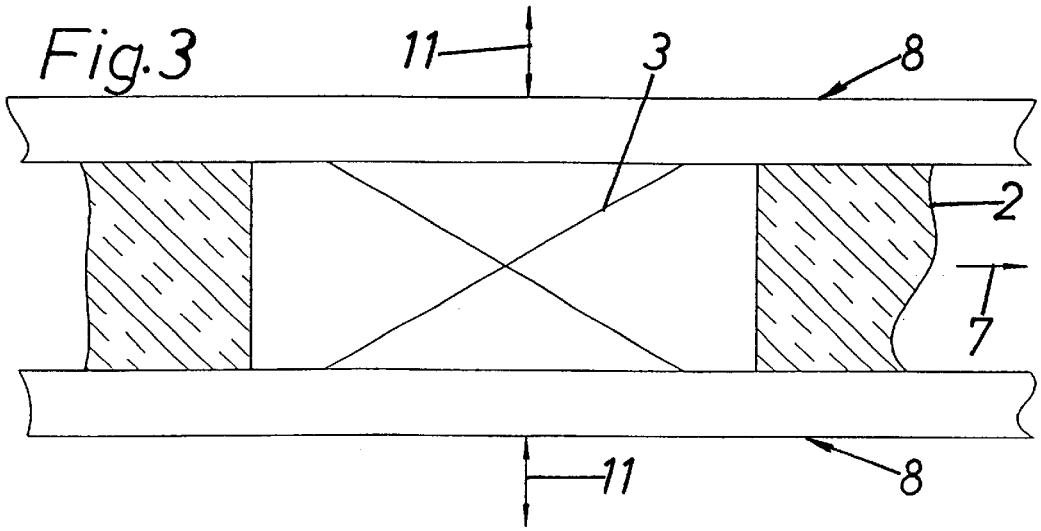
FIG. 3 is a schematic plan view of a portion of the structure shown in FIG. 1.

Each fold line 6 is bounded by two mutually inclined external facets of the respective envelope, and such facets are normal to each other if the envelope is satisfactory, i.e., if the flaps 4 are properly glued, welded or otherwise bonded to the adjacent portions of the envelope. The two guides 8 which are shown in FIGS. 2 and 3 are mirror images of each other with reference to the aforementioned plane which is normal to the plane of FIG. 2 and is disposed midway between the guides. Otherwise stated, the guides 8 of FIGS. 2 and 3 are disposed at opposite sides of the first portion of the path for the packets 3. The distances between the ramp-like sloping surfaces 9 of the guides 8 in the first portion of the path from the upper side of the upper reach of the endless flexible element 2, and the distance between the two guides, are selected in such a way that each of the surfaces 9 bears upon the adjacent fold line 6 with a force sufficient to flex the respective flap 4 further away from the adjacent portion of the envelope in the first portion of the path. This renders the defects of the envelope more pronounced, i.e., more readily detectable in the second portion (at 16 in FIG. 1) of the elongated path. The upstream ends of the surfaces 9 can be chamfered and/or otherwise configurated to ensure smooth advancement of successive (defective and satisfactory) envelopes into the first portion of the path defined by the upper reach of the endless flexible element 2 of the conveyor 1.

The guides 8 at the first portion of the path are longer than a fold line 6, i.e., an entire fold line advancing along the first portion of the path can be acted upon by the respective surface or ramp 9 of the adjacent guide 8. The shorter right-hand guide 8 of FIG. 1 may but need not apply a mechanical deforming force (or a pronounced force) upon the envelopes of the packets 3 which are on their way from the monitoring station (at 16) toward and through the ejecting or segregating unit for packets having defective outer envelopes.

The inclined surfaces 9 of the deforming guides 8 flanking the first portion of the path extending along the upper reach of the endless flexible element 2 make oblique (acute) angles with those external surface portions or facets of an envelope between such guides which flank the respective fold lines. This also contributes to reliability of the deforming action resulting from the application of mechanical forces to the fold lines 6. Such forces need not be pronounced, especially if the outer envelopes constitute converted cellophane blanks, i.e., it suffices to ensure that the surfaces 9 are in mere linear contact with the adjacent envelope (in the regions of the respective fold lines 6).

The double-headed arrows 11 (shown in FIGS. 2 and 3) denote any one of a plurality of suitable means (such as double-acting pneumatic or hydraulic cylinder-and-piston units, rack-and-pinion drives or the like) which can be actuated (either manually or by remote control) to move the two elongated guides 8 shown in FIGS. 2 and 3 nearer to or further away from each other, i.e., transversely of the direction indicated by the arrow 7. This enhances the versatility of the improved apparatus because the apparatus can be readily adjusted to deform and to thereafter detect the defective envelopes of relatively wide or relatively narrow packets 3 advancing along the first and thereupon along the second portion of their path as defined by the upper reach of the endless flexible element 2.

The illustrated monitoring means comprises two senders 12 of suitable radiation which is directed toward the outer sides of loose flaps 4 at a testing station in the clearance or gap 16 located immediately downstream of the first portion of the path. This ensures that the freshly deformed (pivoted) loose flaps 4 are readily detectable. The sensors 12 transmit signals to the respective receivers 13 which, in turn, transmit signals to a suitable evaluating circuit 14 of any known design. The circuit 14 ascertains whether the signals supplied by at least one of the receivers 13 are sufficiently pronounced to warrant segregation of the respective packet 3 (having a defective envelope) from other packets (having satisfactory or acceptable envelopes).

It goes without saying that the inclination of lower portions of the surfaces or ramps 9 shown in FIG. 2 is sufficiently pronounced to permit outward flexing of the respective loose flaps 4 (along the corresponding fold lines 6) in response to the application of mechanical forces against such fold lines during their advancement along the first portion of the path defined by the upper reach of the element 2. This guarantees that the loose flaps entering the clearance 16 (monitoring station) are in a position to influence the radiation issuing from the respective senders 12 of the monitoring means 12–14.

The single deforming station of the apparatus shown in FIG. 1 can be replaced by two deforming stations each of which accommodates one of the two guides 8 shown in FIGS. 2 and 3 and one of which is located downstream of the other (as seen in the direction indicated by the arrow 7).

An important advantage of the improved method and apparatus is that the defects of envelopes are rendered more pronouced, and hence more readily detectable, before a defective envelope reaches the monitoring station. Furthermore, the apparatus is adjustable so that it can treat cigarette packets or analogous block-shaped commodities having different widths, and the apparatus can be readily set up to accentuate the defects of defective envelopes but to avoid any (or any appreciable) deformation of acceptable envelopes wherein the flaps 4 properly adhere to the adjacent portions of the envelopes. Moreover, the apparatus can employ relatively simple (and hence less expensive and rugged) monitoring means because the defects of the defective envelopes are accentuated ahead, particularly immediately ahead, of the monitoring station.

Optical and optoelectronic means for monitoring smokers' products for the presence or absence of other types of defects (such as departure from a desired diameter, open seams and/or smudges on the tubular wrappers of cigarette and/or filter rods, the positions of marginal portions of a running web of cigarette paper and/or others) are disclosed, for example, in commonly owned U.S. Pat. No. 4,645,921 (granted Feb. 24, 1987 to Uwe Heitmann et al. for "APPARATUS FOR TESTING ROD-SHAPED PRODUCTS OF THE TOBACCO PROCESSING INDUSTRY"), U.S. Pat. No. 4,721,119 (granted Jan. 26, 1988 to Dieter Ludszeweit et al. for "ROD MAKING MACHINE WITH MEANS FOR ADJUSTING THE POSITION OF WRAPPING MATERIAL"), and U.S. Pat. No. 4,969,551 (granted Nov. 13, 1990 to Uwe Heitmann et al. for "METHOD OF AND APPARATUS FOR ROLLING ROD-SHAPED ARTICLES"). Similar or analogous monitoring means can be utilized in the apparatus of the present invention.

Without further analysis, the foregoing will so fully reveal the gist of the present invention that others can, by applying current knowledge, readily adapt it for various applications without omitting features that, from the stands point of prior art, fairly constitute essential characteristics of the generic and specific aspects of the above outlined contribution to the art of testing block-shaped commodities and, therefore, such adaptations should and are intended to be comprehended within the meaning and range of equivalence of the appended claims.

What is claimed is:

1. Apparatus for detection of defective envelopes forming part of at least substantially block-shaped commodities, the defective envelopes having external flaps and elongated fold lines for the flaps, the apparatus comprising:

means for advancing, in a predetermined direction and along a predetermined path, successive ones of a series of commodities including randomly distributed commodities having satisfactory envelopes and commodities having defective envelopes;

means for subjecting the envelopes of successive commodities of the series to the action of deforming forces during advancement of commodities along a first portion of said path with attendant intensification of defects of defective envelopes, said means for subjecting including at least one guide adjacent one side of said first portion of said path, said at least one guide having a surface bearing upon a fold line of the envelope in said first portion of said path, and wherein said fold lines are at least substantially parallel to said first portion during advancement of commodities along said first portion of said path; and means for monitoring successive commodities in a second portion of said path downstream of said first portion, including detecting the commodities having defective envelopes.

2. The apparatus of claim 1, wherein said first portion of said path is at least substantially straight.

3. The apparatus of claim 1, wherein the commodities are packets containing arrays of rod-shaped smokers' products.

4. The apparatus of claim 1 for detection of envelopes having external facets flanking the respective elongated fold lines, said surface of said at least one guide making an oblique angle with at least one facet flanking the fold line being advanced along said first portion of said path.

5. The apparatus of claim 4, wherein said oblique angle is an acute angle.

6. The apparatus of claim 1, wherein said surface of said at least one guide is in mere linear contact with the envelopes of commodities being advanced along said first portion of said path.

7. The apparatus of claim 1, wherein said advancing means comprises a conveyor including at least one endless flexible element having an upper reach arranged to advance the series of commodities along said first portion of said path.

8. The apparatus of claim 1, wherein said at least one guide has a downstream end upstream of said second portion of said path.

9. The apparatus of claim 1, wherein said means for subjecting is interrupted at said second portion of said path.

10. The apparatus of claim 2 for detection of envelopes having pairs of external flaps and elongated parallel fold lines for said pairs of flaps, said fold lines being at least substantially parallel to said first portion of said path and said means for subjecting including two guides adjacent opposite sides of said first portion of said path and each having a surface bearing upon one of the two fold lines of the envelope in said first portion of said path.

11. The apparatus of claim 1, further comprising means for adjusting said subjecting means substantially transversely of said first portion of said path.

12. The apparatus of claim 11, wherein said subjecting means comprises two members disposed at opposite sides of said first portion of said path and arranged to simultaneously engage an envelope in said first portion of said path, said members being movable toward and away from each other at least substantially transversely of said first portion of said path.

13. The apparatus of claim 1, further comprising at least one guide for commodities along a third portion of said path downstream of said second portion.

14. A method of enhancing the detection of defective envelopes forming part of block-shaped commodities, comprising the steps of:

advancing, in a predetermined direction and along a predetermined path, successive ones of a series of commodities including randomly distributed commodities having satisfactory envelopes and commodities having defective envelopes;

subjecting the envelopes of successive commodities of the series to the action of deforming forces during advancement of commodities in a first portion of said path with attendant intensification of defects of defective envelopes; and monitoring successive commodities in a second portion of said path downstream of said first portion to detect the commodities having defective envelopes, wherein the envelopes include flaps and the flaps of satisfactory envelopes are bonded to adjacent portions of the respective envelopes, the flaps of defective envelopes being at least partially loose and said subjecting step including moving loose flaps relative to the adjacent portions of defective envelopes.

15. The method of claim 14, wherein the commodities are packets containing arrays of rod-shaped smokers' products.

16. The method of claim 14, wherein the envelopes include pairs of at least substantially mirror symmetrical flaps and said subjecting step includes simultaneously applying deforming forces to pairs of flaps in said first portion of said path.

17. The method of claim 14, wherein said second portion is closely adjacent said first portion of said path.

* * * * *